US010937354B2

(12) United States Patent
Kim et al.

(10) Patent No.: US 10,937,354 B2
(45) Date of Patent: Mar. 2, 2021

(54) ELECTRONIC DEVICE AND CONTROL METHOD THEREOF

(71) Applicant: SAMSUNG ELECTRONICS CO., LTD., Suwon-si (KR)

(72) Inventors: Jihye Kim, Suwon-si (KR); Jiyong Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/727,392

(22) Filed: Dec. 26, 2019

(65) Prior Publication Data

US 2021/0035483 A1 Feb. 4, 2021

(30) Foreign Application Priority Data

Jul. 30, 2019 (KR) ..... 10-2019-0092182

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2310/027* (2013.01); *G09G 2320/0242* (2013.01)

(58) Field of Classification Search
CPC ..... G09G 2320/0242; G09G 3/2003; G09G 3/3208; G09G 2310/027
See application file for complete search history.

(56) References Cited

U.S. PATENT DOCUMENTS

| | | | |
|---|---|---|---|
| 7,502,038 | B2 | 3/2009 | Yasuda et al. |
| 8,013,875 | B2 | 9/2011 | Ogawa et al. |
| 8,749,457 | B2 | 6/2014 | Segawa et al. |
| 9,318,076 | B2 | 4/2016 | Kwak et al. |
| 10,102,821 | B2 | 10/2018 | Cho et al. |
| 10,147,392 | B2 | 12/2018 | Jung et al. |

(Continued)

FOREIGN PATENT DOCUMENTS

| | | | |
|---|---|---|---|
| KR | 10-2014-0069839 | A | 6/2014 |
| KR | 10-2017-0001885 | A | 1/2017 |

(Continued)

OTHER PUBLICATIONS

Written Opinion (PCT/ISA/237) dated May 19, 2020, issued by the International Searching Authority in International Application No. PCT/KR2020/001081.

(Continued)

*Primary Examiner* — Muhammad N Edun
(74) *Attorney, Agent, or Firm* — Sughrue Mion, PLLC

(57) ABSTRACT

An electronic device including: a display including light emitting elements; a memory storing correction coefficients of the light emitting elements of the display; and a processor configured to identify gray scale information and color information of an input image based on pixel information of the input image, based on the gray scale information of the input image being less than a threshold gray scale, adjust a correction coefficient, among the correction coefficients, of a light emitting element among the light emitting elements of the display based on the color information of the input image, and obtain an output image based on the adjusted correction coefficient.

14 Claims, 9 Drawing Sheets

(56) References Cited

U.S. PATENT DOCUMENTS

| | | | | |
|---|---|---|---|---|
| 2007/0222712 | A1* | 9/2007 | Chiaki | G09G 3/2077 345/63 |
| 2008/0088649 | A1* | 4/2008 | Ikeno | G09G 3/3611 345/690 |
| 2012/0147070 | A1 | 6/2012 | Segawa et al. | |
| 2014/0152718 | A1 | 6/2014 | Kwak et al. | |
| 2015/0248210 | A1 | 9/2015 | Lee et al. | |
| 2016/0253944 | A1* | 9/2016 | Lu | G09G 3/3413 345/589 |
| 2018/0075795 | A1* | 3/2018 | Lin | G09G 3/36 |
| 2018/0144716 | A1 | 5/2018 | Jung et al. | |
| 2018/0254020 | A1 | 9/2018 | Buckley et al. | |
| 2018/0295312 | A1 | 10/2018 | Cho et al. | |
| 2019/0132001 | A1* | 5/2019 | Deng | H03M 7/3071 |
| 2019/0221171 | A1* | 7/2019 | Zha | G09G 3/342 |

FOREIGN PATENT DOCUMENTS

| | | | |
|---|---|---|---|
| KR | 10-1699089 | B1 | 1/2017 |
| KR | 10-2018-0018898 | A | 2/2018 |
| KR | 10-2018-0058048 | A | 5/2018 |

OTHER PUBLICATIONS

International Search Report (PCT/ISA/210) dated May 19, 2020, issued by International Searching Authority in International Application No. PCT/KR2020/001081.

* cited by examiner

ELECTRONIC DEVICE AND CONTROL METHOD THEREOF

CROSS-REFERENCE TO RELATED APPLICATION(S)

This application is based on and claims priority under 35 U.S.C. § 119 to Korean Patent Application No. 10-2019-0092182, filed on Jul. 30, 2019, in the Korean Intellectual Property Office, the disclosure of which is incorporated by reference herein in its entirety.

BACKGROUND

1. Field

The disclosure relates to an electronic device and a control method thereof. More particularly, the disclosure relates to an electronic device adjusting a correction coefficient and a control method thereof.

2. Description of Related Art

In the related art, an output image is generated in which red, green, and blue colors are appropriately combined according to gray scales by applying a correction coefficient to an input image of a light emitting diode (LED) display. Therefore, three lights are displayed in entire gray scale of the output image regardless of the pixel values of red, green, and blue colors included in the input image.

In other words, there is a problem in that, even though only a pure blue color is included in the input image and there is no input value of red and green colors, red and green colors are displayed on the output image.

SUMMARY

Provided is an electronic device to improve uniformity of an output image by reducing light intensity of a red color and a green color in a low gray scale region of an output image, when only a blue color is included in an input image, and there are no input values for red and green colors, and a control method thereof.

In accordance with an aspect of the disclosure, there is provided an electronic device including: a display including light emitting elements; a memory storing correction coefficients of the light emitting elements of the display; and a processor configured to identify gray scale information and color information of an input image based on pixel information of the input image, based on the gray scale information of the input image being less than a threshold gray scale, adjust a correction coefficient, among the correction coefficients, of a light emitting element among the light emitting elements of the display based on the color information of the input image, and obtain an output image based on the adjusted correction coefficient.

The processor may be further configured to, based on the gray scale information of the input image being less than the threshold gray scale and the color information of the input image being a blue color, adjust a correction coefficient, among the correction coefficients, of a light emitting element corresponding to the blue color among the light emitting elements of the display.

The correction coefficient includes a plurality of parameters for calculating each of red (R), green (G) and blue (B) sub-pixel values in the output image, and the processor may be further configured to adjust a parameter, among the plurality of parameters, for calculating at least one of the R and G sub-pixel values in the output image.

The processor may be further configured to, based on the gray scale information of the input image being less than a first threshold gray scale, adjust a parameter, among the plurality of parameters, for calculating at least one of the R and G sub-pixels included in the output image, to zero, and based on the gray scale information of the input image being greater than or equal to the first threshold gray scale and less than a second threshold gray scale, adjust a parameter, among the plurality of parameters, for calculating at least one of the R and G sub-pixels included in the output image, to a specific value.

The specific value may be determined based on the first threshold gray scale, the second threshold gray scale, and the information on gray scale of the input image.

The first threshold gray scale may be determined in a pixel value section in which a B sub-pixel value included in the input image may be greater than zero and is less than a first value, and the second threshold gray scale may be determined in a pixel value section in which a B sub-pixel value included in the input image is greater than each of the R and G sub-pixels by at least a threshold range.

The electronic device may further include a sensor, wherein the processor may be further configured to, based on the output image being a still image or a distance between the electronic device and a user sensed by the sensor being within a threshold distance, adjust the correction coefficient of the light emitting element.

The processor may be further configured to, based on a region having a blue color in the input image being greater than or equal to a threshold size, and gray scale information of the region being less than the threshold gray scale, adjust a correction coefficient, among the correction coefficients, of a light emitting element corresponding to a pixel included in the region among the light emitting elements of the display.

The light emitting elements may include light emitting diodes (LED) elements, the display includes a plurality of display modules, and each display module of the plurality of display modules may be implemented as an LED cabinet including the LED elements.

In accordance with an aspect of the disclosure, there is proved a method of controlling an electronic device storing correction coefficients of light emitting elements included in a display, the method including: identifying gray scale information and color information of an input image based on pixel information of the input image; based on the gray scale information of the input image being less than a threshold gray scale, adjusting a correction coefficient, among the correction coefficients, of a light emitting element among the light emitting elements of the display based on the color information of the input image; and obtaining an output image based on the adjusted correction coefficient.

The adjusting the correction coefficient may include, based on the gray scale information of the input image being less than the threshold gray scale and the color information of the input image being a blue color, adjusting a correction coefficient, among the correction coefficients, of a light emitting element corresponding to the blue color among the light emitting elements of the display.

The correction coefficient may include a plurality of parameters for calculating each of red (R), green (G), and blue (B) sub-pixel values in the output image, and the adjusting the correction coefficient may further include adjusting a parameter, among the plurality of parameters, for calculating at least one of the R and G sub-pixel values in the output image.

The adjusting the correction coefficient may further include: based on the gray scale information of the input image being less than a first threshold gray scale, adjusting a parameter, among the plurality of parameters, for calculating at least one of the R and G sub-pixels included in the output image, to zero, and based on the gray scale information of the input image being greater than or equal to the first threshold gray scale and less than a second threshold gray scale, adjusting a parameter, among the plurality of parameters, for calculating at least one of the R and G sub-pixels included in the output image, to a specific value.

The specific value may be determined based on the first threshold gray scale, the second threshold gray scale, and the information on gray scale of the input image.

The first threshold gray scale may be determined in a pixel value section in which a B sub-pixel value included in the input image is greater than zero and is less than a first value, and the second threshold gray scale may be determined in a pixel value section in which a B sub-pixel value included in the input image is greater than each of the R and G sub-pixels by at least a threshold range.

The adjusting the correction coefficient may include, based on the output image being a still image or a distance between the electronic device and a user being within a threshold distance, adjusting the correction coefficient of the light emitting element.

The adjusting the correction coefficient may include, based on a region having a blue color in the input image being greater than or equal to a threshold size, and gray scale information of the region being less than the threshold gray scale, adjusting a correction coefficient, among the correction coefficients, of a light emitting element corresponding to a pixel included in the region among the light emitting elements of the display.

The light emitting elements may include light emitting diodes (LED) elements, the display may include a plurality of display modules, and each display of the plurality of display modules may be implemented as an LED cabinet including the LED elements. As described above, according to various embodiments, when only a blue color is included in an input image, and if there is no input value of red and green colors, or if the input value is less than or equal to a threshold value, light intensity of red and green colors may be reduced in an output image, and uniformity of the output image may be enhanced.

BRIEF DESCRIPTION OF THE DRAWINGS

The above and/or other aspects, features, and advantages of certain embodiments of the disclosure will be more apparent from the following description taken in conjunction with the accompanying drawings, in which.

DETAILED DESCRIPTION

Figure 1:
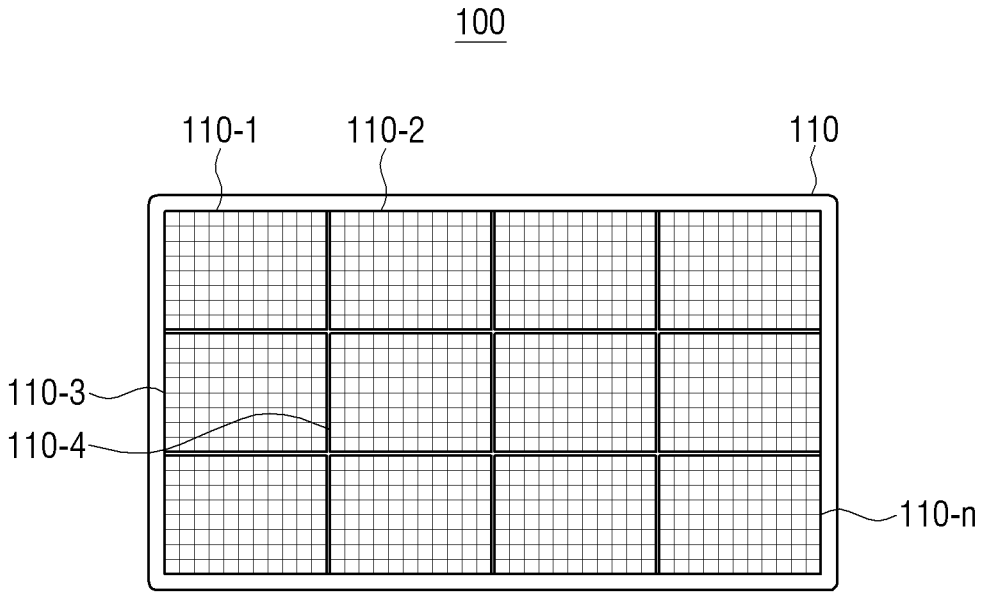
FIG. 1 is a view illustrating a configuration of an electronic device according to an embodiment.

The disclosure will be further described with reference to the accompanying drawings.

Terms used herein are used to help understand the disclosure, but may be changed depending on the intention of those skilled in the art or a judicial precedent, the emergence of a new technique, and the like. In addition, in a specific case, terms may be arbitrarily chosen. In such case, the meaning of such terms will be mentioned in detail in a corresponding description of the disclosure. Therefore, the terms used in embodiments herein should be defined on the basis of the meaning of the terms and the contents throughout the disclosure.

The disclosure may be variously modified and have different embodiments. Here, specific embodiments will be described in detail with reference to the accompanying drawings. However, it is to be understood that the disclosure is not limited to specific embodiments, but includes all modifications, equivalents, and substitutions without departing from the scope and spirit of the disclosure.

The singular forms "a," "an," and "the" may include plural forms unless the context clearly indicates otherwise. It will be further understood that terms "include" or "formed of" used herein may specify the presence of features, numerals, steps, operations, components, parts, or combinations thereof, but do not preclude the presence or addition of one or more other features, numerals, steps, operations, components, parts, or combinations thereof.

It should be understood that at least one of A and B indicates "A", "B" or both "A and B".

As used herein, the terms "first," "second," or the like may denote various components, regardless of order and/or importance, and may be used to distinguish one component from another, and do not limit the components.

In addition, the description that one element (e.g., a first element) is operatively or communicatively coupled with/to or connected to another element (e.g., a second element) should be interpreted to include a case in which the one element is directly coupled to the another element, and a case which the one element is coupled to the another element through still another element (e.g., a third element).

The term such as "module," "unit," "part", and so on may refer to an element that performs at least one function or operation, and such element may be implemented as hardware or software, or a combination of hardware and software. Further, except when each of a plurality of "modules", "units", "parts", and the like needs to be realized in an individual hardware, the components may be integrated in at least one module or chip and be realized in at least one processor. In this disclosure, the term "user" may refer to an electronic device or a person using the electronic device, or a device using the electronic device (for example, an AI electronic device).

The disclosure may be embodied in many different forms and is not limited to the embodiments described herein. In order to clearly illustrate the disclosure in the drawings, portions which may not be related to the description may be omitted, and like reference numerals have been assigned to similar portions throughout the disclosure.

FIG. 1 is a view illustrating a configuration of an electronic device according to an embodiment.

Referring to FIG. 1, an electronic device 100 according to an embodiment may be implemented as a display device that physically connects a plurality of display modules 110-1, 110-2, 110-3, 110-4 . . . **110-*n*. Here, each of the plurality of display modules 110-1, 110-2, 110-3, 110-4 . . . 110-*n*** may include a plurality of light emitting diode (LED) pixels arranged in a matrix form.

Further, each of the plurality of display modules may be implemented with an LED cabinet that includes a plurality of LED elements. Here, the LED element may be implemented as a red-green-blue (RGB) LED, and the RGB LED may include a red LED, a green LED, and a blue LED. In addition, the LED element may additionally include a white LED, in addition to an RGB LED.

The LED element may be a self-emitting element and implemented as a micro LED. For example, the micro LED may have the size of about 5-100 micrometers, and may be a micro-sized light-emitting element which emits lights without a color filter.

The electronic device 100 may be implemented as a television (TV), but is not limited thereto, and may be applicable to any device having a display function such as a video wall, a large format display (LFD), a digital signage, and a digital information display (DID), a projector display, or the like. In addition, the electronic device 100 may be implemented as various types displays, such as a liquid crystal display (LCD), an organic light-emitting diode (OLED), a liquid crystal on silicon (LCoS), a digital light processing (DLP), a quantum dot (QD) display panel, a quantum dot light-emitting diodes (QLED), a micro LED, or the like.

In general, the electronic device 100 may acquire an output image in which a red color, a green color, and a blue color are mixed by applying a correction coefficient to the pixel information included in an input image. Specifically, an output image may be acquired by applying the correction coefficient as Equation 1 below:

$$\begin{bmatrix} CC_{00} & CC_{01} & CC_{02} \\ CC_{10} & CC_{11} & CC_{12} \\ CC_{20} & CC_{21} & CC_{22} \end{bmatrix} \begin{bmatrix} R \\ G \\ B \end{bmatrix} = \begin{bmatrix} CC_{00} \times R & CC_{01} \times G & CC_{02} \times B \\ CC_{10} \times R & CC_{11} \times G & CC_{12} \times B \\ CC_{20} \times R & CC_{21} \times G & CC_{22} \times B \end{bmatrix} = \begin{bmatrix} R' \\ G' \\ B' \end{bmatrix} \quad \text{Equation 1}$$

Here, R, G, and B denote red color, green color, and blue color, respectively, included in an input image. R', G', and B' denote red color, green color, and blue color, respectively, included in an output image, and CC denotes a correction coefficient.

The process of acquiring pixel information of the output image according to Equation 1 is called gamut mapping. The correction coefficient is a coefficient for causing the pixel value of each light emitting device to have uniformity, and may also be called a gamut mapping coefficient. Here, a gamut is a range of colors that may be represented in a display device. In addition, gamut mapping is mapping of color information from one color space to another color space, and according to the embodiments, the gamut mapping corresponds to a case of mapping color information from a color space of an input image to a color space of an output image.

According to Equation 1, even if the pixel values of the red color and the green color included in the input image are 0 (R=0, G=0), the output image may include red color and green color by the correction coefficients $CC_{02}$ and $CC_{12}$. In other words, even when trying to output a pure blue color, the output image may include red and green colors, and in a region with a lower gray scale level, red color and green color may be easily exposed to the user. That is, the red color and the green color that appear when the R subpixel and the G subpixel emit light in the blue color output image may correspond to noise.

Various embodiments of reducing light intensity of red and green colors of each pixel included in the output image by adjusting a correction coefficient will be described in detail.

Figure 2:
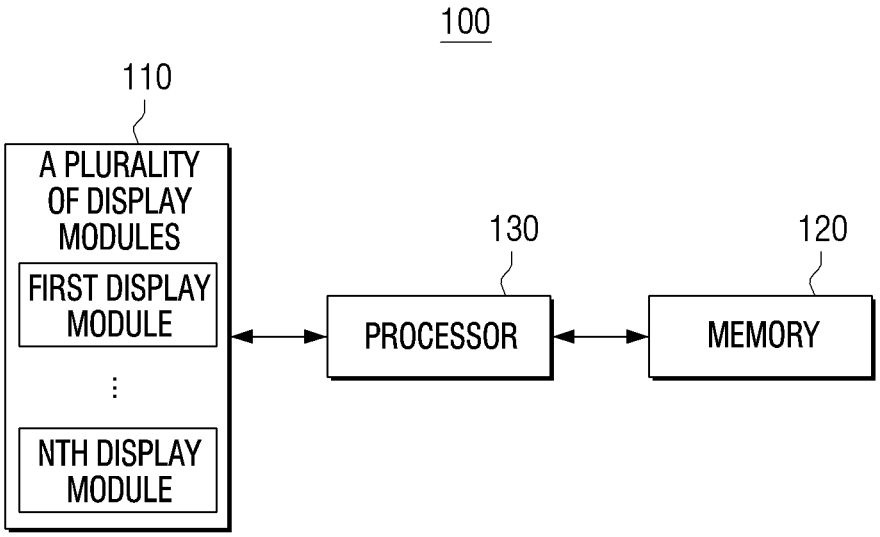
FIG. 2 is a block diagram illustrating a configuration of an electronic device according to an embodiment.

FIG. 2 is a block diagram illustrating a configuration of an electronic device according to an embodiment.

Referring to FIG. 2, the electronic device 100 may include a plurality of display modules 110, a memory 120, and a processor 130.

Each of the plurality of display modules 110 may include a plurality of pixels arranged in a matrix form. In particular, each of the plurality of display modules 110-1 . . . , **110-*n*** may be a module including a plurality of LED elements. According to one embodiment, the LED element may be implemented as an RGB LED, and the RGB LED may include red LED, green LED, and blue LED together. In addition, the LED element may additionally include a white LED, in addition to the RGB LED.

The LED element may be implemented as a micro LED. Here, the micro LED may be a LED at a size of about 5 to 100 micrometers and may be a micro-sized light emitting element that emits light by itself without a color filter.

The memory 120 may be electrically connected to the processor 130, and may store data that is necessary for various embodiments.

The memory 120 may be implemented as a memory embedded in the electronic device 100, or may be implemented as a detachable memory in the electronic device 100, according to the purpose of data usage. For example, data for driving the electronic device 100 may be stored in a memory embedded in the electronic device 100, and data for an additional function of the electronic device 100 may be stored in the memory detachable to the electronic device 100. A memory embedded in the electronic device 100 may be a volatile memory, such as a dynamic random access memory (DRAM), a static random access memory (SRAM), a synchronous dynamic random access memory (SDRAM), or a nonvolatile memory, such as one-time programmable ROM (OTPROM), programmable ROM (PROM), erasable and programmable ROM (EPROM), electrically erasable and programmable ROM (EEPROM), mask ROM, flash ROM, a flash memory (for example, NAND flash or NOR flash), a hard disk drive or a solid state drive (SSD). In the case of a memory detachably mounted to the electronic device 100, the memory may be implemented as a memory card (for example, a compact flash (CF), secure digital (SD), micro secure digital (micro-SD), mini secure digital (mini-SD), extreme digital (xD), multi-media card (MMC), and etc.), an external memory (for example, a USB memory) connectable to the USB port, or the like.

According to an embodiment, the memory 120 may be included in each of the plurality of display modules 110. The memory 120 may store correction coefficients for light emitting elements included in each of the plurality of display modules 110.

The correction coefficient is a coefficient to make a pixel value of each light emitting element to be uniform and may be called a gamut mapping coefficient. Herein below, it will be collectively named a correction coefficient.

Embodiments are not limited thereto and the memory 120 may be present for each of a plurality of display modules 110.

The memory 120 may store information on a binning group, information on colors by pixels, information on maximum brightness by pixels, or the like. Here, the binning group may be an LED pixel group having the same characteristics (color, color coordinate, brightness, or the like) as much as possible.

The processor 130 may be electrically connected to the memory 120 and may control overall operation of the electronic device 100.

The processor 130 may be implemented with a digital signal processor (DSP), a microprocessor, and a timing controller (TCON) which process a digital image signal, but this is not limited thereto. The processor 130 may include one or more among a central processing unit (CPU), a micro controller unit (MCU), a micro processing unit (MPU), a controller, an application processor (AP), a communication processor (CP), an advanced reduced instruction set computing (RISC) machine (ARM) processor, an artificial intelligence (AI) processor or may be defined as a corresponding term. The processor 130 may be implemented with system on chip (SoC) type or a large scale integration (LSI) type which a processing algorithm is built therein or in a field programmable gate array (FPGA) type. The processor 130 may perform various functions by executing computer executable instructions stored in the memory 120.

The processor 130 according to an embodiment may identify gray scale information and color information of the input image based on pixel information included in the input image. Here, the input image may be an image source input from an external device, such as a source box, a control box, a sending box, a set top box, or the like. The pixel information may include information on each pixel, and may include gray level information and color information. Here, the gray scale information may be information indicating a gray scale level and may include gray scale information for each of R, G, and B colors. For example, in the case of an 8-bit image, the gray scale information may represent zero 0 to 255 levels, and in the case of a 10-bit image, the gray scale level information may represent 0 to 1023 levels. Also, the color information may be determined by gray scale level information of R, G, and B. For example, when R=0, G=0, and B=255 in an 8-bit image, the color information may be a pure blue color.

When the gray scale information of the input image is less than a threshold gray scale, the processor 130 may adjust the correction coefficient of the light emitting element included in the display based on the color information of the input image. Here, the display may include a plurality of display modules 110.

Specifically, the processor 130 may adjust the correction coefficients of each pixel included in the plurality of display modules 110. Here, the correction coefficients may include a plurality of parameters used for calculating each of the R, G, and B sub-pixel values included in the output image. The plurality of parameters refers to correction coefficients $CC_{00}$ to $CC_{22}$ described in Equation 1.

If a region has a lower gray scale, a user may more easily recognize color of light emitted from each sub-pixel. Therefore, when a pure blue color is to be output from the low gray scale region, and if R sub-pixel and a G sub-pixel emit light, the user may easily recognize the red and green light. However, when the pixel information of the output image is calculated using the correction coefficient as shown above in Equation 1, even if only the blue color is included in the input image, the output image may include red and green colors.

Accordingly, the processor 130 may adjust the correction coefficient in order to reduce light intensity of red color and green color included in the output image.

Specifically, when the gray scale information of the input image is less than the threshold gray scale and the color information of the input image is identified as a blue color, the processor 130 may adjust the correction coefficient of the light emitting element corresponding to the blue color. Here, the correction coefficient of the light emitting device corresponding to the blue color means $CC_{02}$ and $CC_{12}$ in Equation 1. $CC_{02}$ and $CC_{12}$ may be expressed as parameters used for calculating at least one of R and G subpixel values included in an output image among a plurality of parameters. In addition, when the color information of the input image is blue, not only the pixel values of the input image are R=0, G=0, B≠0, but also the pixel values may be R≠0, G≠0, B≠0, and B may be greater than R and G by a threshold range or more.

According to an embodiment, $CC_{02}$ and $CC_{12}$ may be divided into three sections based on a plurality of threshold gray scale values. This will be further described in FIG. 4.

Figure 4:
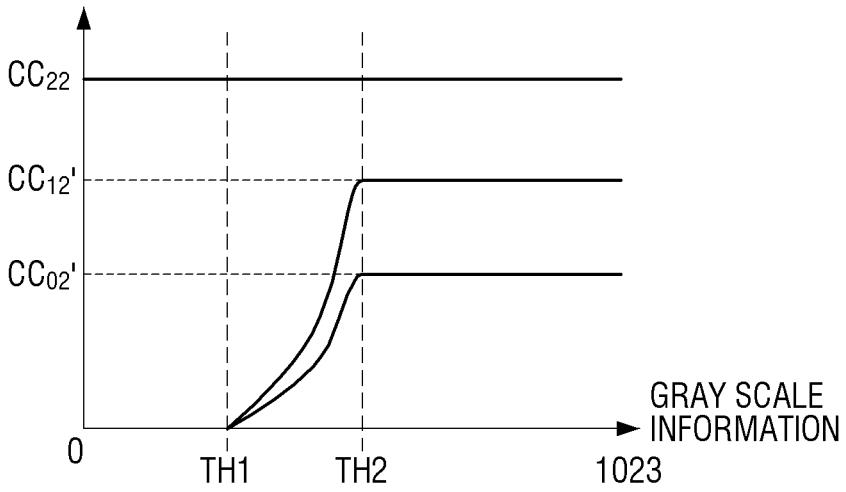
FIG. 4 is a view to describe a correction coefficient according to a threshold gray scale according to an embodiment.

FIG. 4 is a view to describe a correction coefficient according to a threshold gray scale according to an embodiment.

For example, when the gray scale information of the input image is less than a first threshold gray scale TH1, the processor 130 may adjust the parameter value that is used for calculating at least one of R and G subpixel values, included in the output image among the plurality of parameters, to 0. Here, the parameter used to calculate at least one of the R and G subpixel values included in the output image may be at least one of $CC_{02}$ and $CC_{12}$ in Equation 1. When the value is less than the first threshold gray scale, it means that the gray scale value is very low, and the red and green colors may be easily exposed to the user in the lower gray scale region. Therefore, the processor 130 may adjust $CC_{02}$ and $CC_{12}$ to 0 when the gray value of the input image is very low. As such, if the pixel values of the red color and green color included in the input image are 0 (R=0, G=0), the pixel values of red color R' and green color G' included in the output image according to Equation 1 is 0, and the pure blue color may be output to the output image. However, adjusting the parameter value to 0 is merely an example, and the parameter value may be adjusted to a value other than 0.

If the gray scale information of the input image is greater than or equal to the first threshold gray scale TH1 and less than a second threshold gray scale TH2, the processor 130 may adjust the parameter values used for calculation of at least one of R and G sub-pixel values included in the output image among the plurality of parameters into a specific value. The case where the gray scale value is greater than or equal to the first threshold gray scale and less than the second threshold gray scale means that the gray scale value is low, and even if the blue color is output, red color and green color may be exposed to a user. Thus, the processor 130 may adjust the correction coefficients $CC_{02}$ and $CC_{12}$ to specific values.

Here, the specific values may be determined based on the threshold gray scale, first threshold gray scale, and information on the gray scale of the input image. Specifically, the specific value may be determined based on Equation 2 below:

$$CC_{02}'=(CC_{02}/TH2-TH1)\times(\text{input}-TH1)$$

$$CC_{12}'=(CC_{12}/TH2-TH1)\times(\text{input}-TH1) \qquad \text{Equation 2}$$

Here, $CC_{02}'$ and $CC_{12}'$ are an adjusted correction coefficient, TH1 is the first threshold gray scale, and TH2 is the second threshold gray scale. The input means gray scale information of each of B sub-pixels of the input image.

The determination of the parameter value according to Equation 2 is merely an example and may be determined by a different method. For example, Equation 2 is a first order equation, but a parameter value may be determined through a multi-order equation other than the first order equation, or a parameter value may be a constant.

It has been described that there are two threshold gray scale values, but this is merely an example, and the threshold gray scale value may be just one or more than two.

If the gray scale information of the input image is greater than or equal to the second threshold gray scale, the processor 130 may use the correction coefficient stored in the memory 120 as it is without adjusting. The gray scale information being greater than the second threshold gray scale means that the gray scale value is not low. In this case, even if red and green colors are output when the blue color is output, the user may not easily recognize this. Therefore, the processor 130 may not need to separately adjust the correction coefficients stored in the memory 120.

In FIG. 4, the gray scale information means gray scale information of one pixel included in the plurality of display modules 110.

The first threshold coefficient and the second threshold coefficient may be set in a specific section. This will be described in further detail with reference to FIG. 5.

Figure 5:
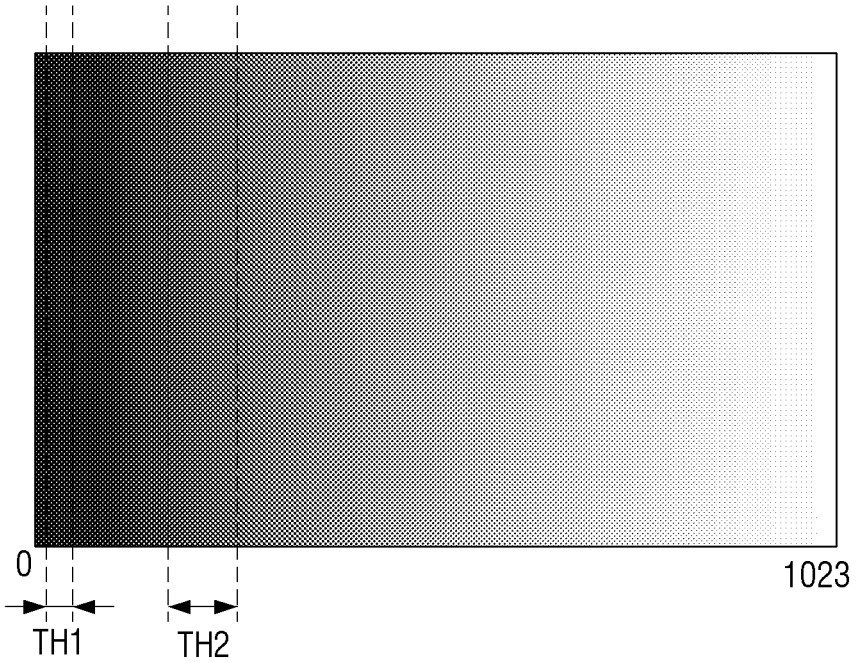
FIG. 5 is a view to describe a section in which a first threshold coefficient and a second threshold coefficient are set according to an embodiment.

FIG. 5 is a view to describe a section in which a first threshold coefficient and a second threshold coefficient are set according to an embodiment.

The first threshold gray scale TH 1 may be determined in a pixel value section in which the B sub-pixel value included in the input image is greater than 0 and less than the first value. For example, if it the image is 10 bits and the gray scale information range is set from 0 to 1023, the first threshold gray scale may range from level 0 to level 20. For example, the first threshold gray scale may set to level 15.

In addition, the second threshold gray scale TH2 may be determined in a pixel value section in which the B sub-pixel value included in the input image is greater than the R and G sub-pixel values by more than a threshold range. Also, the second threshold gray scale may be determined in a section greater than the first value. For example, if the image is 10 bits and the gray scale information range is set from 0 to 1023 levels, the second threshold gray scale may range from level 200 to level 400. Specifically, for example, the second threshold gray scale may set to level 300.

The value of the section in which the third threshold gray scale and the second threshold gray scale are disposed is merely an example, and the value may be determined in other sections.

The value of the section where the first threshold gray scale and the second threshold gray scale may be determined may be changed according to the number of image bits.

When the output image is a still image, or a distance between the electronic device 100 and the user sensed by a sensor is within a threshold distance, the processor 130 may adjust the correction coefficient of the light emitting element included in at least one of the plurality of display modules.

This is because when the output image is a moving image, the scene change speed is fast and the user may not recognize the red and green colors included in the output image of the blue color. In contrast, the still image may not only include one scene that does not move during the threshold time, but there may be a case where the change in pixel value between scenes is equal to or less than the threshold value. The pixel value may be calculated as an average value of pixels of a scene or an average value of a pixel of a predetermined area.

The processor 130 may identify the distance between the electronic device 100 and the user based on information obtained through a sensor. Here, the sensor may be implemented as an infrared (IR) sensor, an ultrasonic sensor, or the like. Specifically, distance information may be obtained based on a period of a signal emitted from the sensor, and reflected from a target object (e.g., user) and returned to the sensor.

The sensor may be implemented as a camera. A user may be recognized from the image that is photographed by a camera provided in the electronic device 100, and distance information may be obtained.

In addition, the distance between the electronic device 100 and the user may be replaced by the distance between the electronic device 100 and the remote control device. In general, a user controls an operation of the display device using a remote control device, and thus, in an environment where the user watches a display, the remote control device is generally located nearby the user. In this case, distance information between the electronic device 100 and the remote control device may be obtained based on a time in which a signal transmitted from the remote control device to the electronic device 100 returns to the remote control device. The processor 130 may receive distance information obtained from the remote control device.

When the distance between the electronic device 100 and the user obtained by the above method is identified as being within a threshold distance, the processor 130 may adjust the correction coefficient of the light emitting element included in at least one of the display modules. This is because when the distance between the electronic device 100 and the user is greater than the threshold distance, the user may not recognize red and green colors included in the output image of the blue color. Therefore, in this case, the amount of calculation of the processor 130 may be reduced, as the correction coefficient is not adjusted.

The threshold distance may change according to the size of the electronic device 100, and may be changed by the user's operation.

When a region having the blue color in the input image is greater than or equal to the threshold size, and the gray scale information of the region is less than the threshold gray scale, the processor 130 may adjust the correction coefficient of the light emitting element corresponding to the pixels included in the corresponding region.

When a region having the blue color is less than the threshold size, the user may not recognize red color and green color included in the output image of the blue color. Here, the threshold size may change according to the size of the electronic device 100, or by the user's operation.

Noises of the red and green colors included in the output image of blue color have been described above, but various embodiments may be applied. For example, the correction coefficient may be adjusted when the green and blue colors are included in the output image of red color, or the red and blue colors are included in the output image of the green color. Furthermore, when the correction coefficient to be adjusted is changed, the first threshold gray scale and the second threshold gray scale may also be changed.

It has been described that the processor 130 of the electronic device 100 adjusts the correction coefficient, but a processor of external devices, such as the source box, control box, sending box, set-top box, or the like, may adjust the correction coefficient and provide the adjusted correction coefficient to the electronic device 100.

Figure 3:
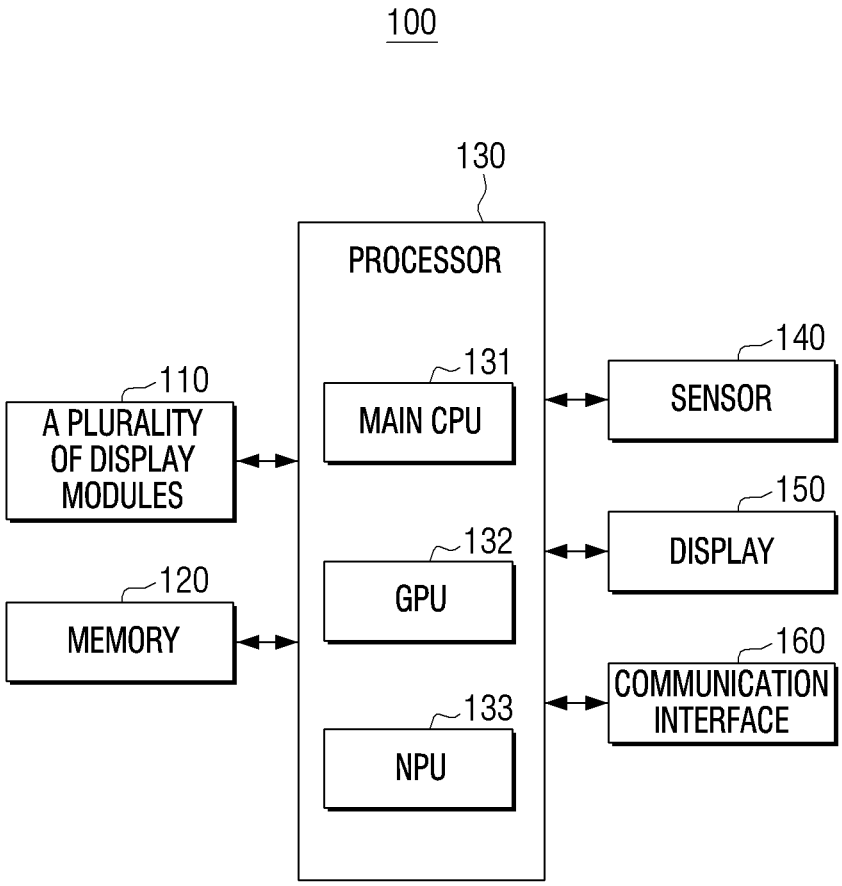
FIG. 3 is a block diagram illustrating a detailed configuration of an electronic device according to an embodiment.

FIG. 3 is a block diagram illustrating a detailed configuration of an electronic device according to an embodiment.

Referring to FIG. 3, the electronic device 100 may include a plurality of display modules 110, a memory 120, a processor 130, a sensor 140, a display 150, and a communication interface 160.

The plurality of display modules 110 may have a format in which several display modules formed of a plurality of LED modules are connected. That is, the plurality of display modules 110 may include a plurality of cabinets.

As described above, the electronic device 100 including the plurality of display modules 110 may be implemented as a large format display (LFD) or the like and may be used as an outdoor display device, such as an electronic display board.

The processor 130 may control overall operations of the electronic device 100 using various programs stored in the memory 120. The processor 130 may include a graphic processing unit 132 for graphic processing corresponding to the image. The processor 130 may be implemented as a system on chip (SoC) including a core and a graphics processing unit (GPU) 132. The processor 130 may include a single core, dual cores, triple cores, quad cores, and/or multiple cores.

The processor 130 may include a main CPU 131, GPU 132, and a neural processing unit (NPU) 133.

The main CPU 131 may access the memory 120 and perform booting using O/S stored in the memory 120. The main CPU 131 performs various operations using various programs and contents data, or the like, stored in the memory 120. According to an embodiment, the main CPU 131 may copy a program stored in the memory 120 to random access memory (RAM) according to an instruction stored in read-only memory (ROM), access the RAM, and execute a corresponding program.

The GPU 132 may correspond to a high performance processing device for graphics processing, and may be a specialized electronic circuit designed to accelerate image generation in a frame buffer to quickly process and change a memory and output the processed result to a screen. In addition, the GPU 132 may mean a visual processing unit (VPU).

The NPU 133 may be an AI chipset (or AI processor) and may be an AI accelerator.

The sensor 140 may be configured to obtain distance information between the electronic device 100 and a user. The sensor 140 may be implemented as an IR sensor, an ultrasonic sensor, a camera, or the like.

The display 150 may be configured to display an output image to which the correction coefficient is applied.

The display 150 may be implemented as various types including a video wall, a large format display (LFD), a digital signage, digital information display (DID), a projector display, or the like.

A method of implementing the display 150 may be diverse, such as a liquid crystal display (LCD), organic light-emitting diode (OLED), liquid crystal on silicon (LCoS), digital light processing (DLP), a quantum dot (QD) display panel, quantum dot light-emitting diodes (QLED), micro light-emitting diodes (micro LED), or the like.

A communication interface 160 including circuitry may be configured to communicate with an external device. Specifically, communication interface 160 may receive an input image from an external device. Here, the external device may be implemented as a source box, a control box, a sending box, a set-top box, or the like. Also, the external device may be implemented as a videowall processor, a multi-video output PC, a matrix multiplexer, a server, or the like.

The communication interface 160 may include a Wi-Fi module, a Bluetooth module, infrared (IR) module, local area network (LAN) module, wireless communication module, or the like. Here, each communication module may be implemented with at least one hardware chip format. The wireless communication module may include at least one communication chip performing communication according to various communication standards, such as Zigbee, $3^{rd}$, Ethernet, universal serial bus (USB), mobile industry processor interface camera serial interface (MIPI CSI), third generation (3G), $3^{rd}$ generation partnership project (3GPP), long term evolution (LTE), LTE advanced (LTE-A), $4^{th}$ generation (4G), $5^{th}$ generation (5G), or the like, in addition to the communication modes described above. These are merely examples, and the communication interface 160 may use at least one communication module among various communication modules.

The communication interface 160 may include input and output interface. Specifically, the communication interface 160 may be implemented as one interface among one of the high-definition multimedia interface (HDMI), mobile high-definition link (MHL), universal serial bus (USB), display port (DP), Thunderbolt, video graphics array (VGA) port, RGB port, d-subminiature (D-SUB), digital visual interface (DVI), and the like, and receive an input image from an external device. For example, when the external device is implemented as a source box, an input image may be transmitted from the connected source box by the HDMI.

Figure 6:
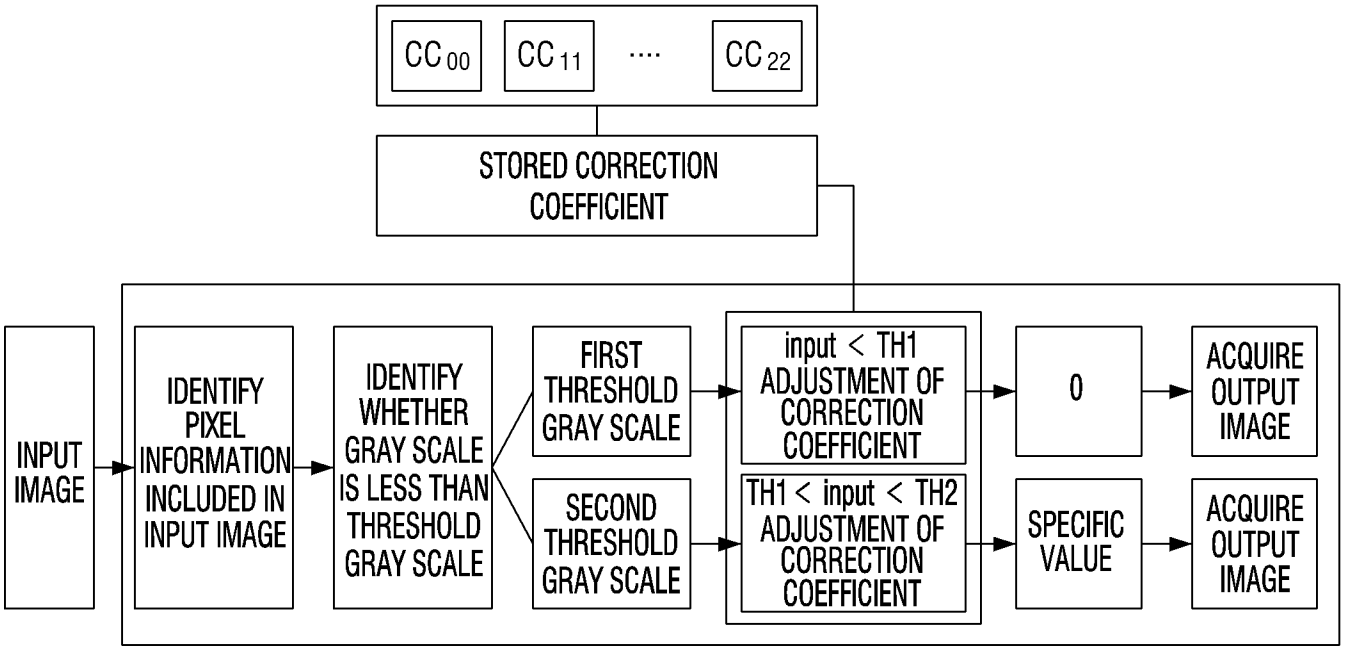
FIG. 6 is a view to describe a process of obtaining an output image from an input image according to an embodiment.

FIG. 6 is a view to describe a process of obtaining an output image from an input image according to an embodiment.

When an input image is received from an external device, the electronic device 100 may identify pixel information included in the input image. The electronic device 100 may identify gray scale information and color information of the input image.

The electronic device 100 may identify whether the gray scale information of the input image is less than the threshold gray scale. Here, the threshold gray scale means the second threshold gray scale. When the gray scale information of the input image is identified as less than the threshold gray scale, the electronic device 100 may identify whether the gray scale information is less than the first threshold gray scale or more than the first threshold gray scale and less than the second threshold gray scale.

If the gray scale information of the input image is less than the first threshold gray scale, the electronic device 100 may adjust the correction coefficient (parameter values) used for calculation of at least one among the R and G sub-pixels among the stored correction coefficients to 0. Here, the correction coefficient used for calculation of at least one of R and G sub-pixels may mean $CC_{02}$ and $CC_{12}$ in Equation 1.

Alternatively, if the gray scale information of the input image is greater than or equal to the first threshold gray scale and less than the second threshold gray scale, the electronic device 100 may calculate a correction coefficient ($CC_{02}$ and $CC_{12}$) used to calculate at least one of the R and G sub-pixel values among the stored correction coefficients to specific values. Here, the specific value may be determined based on the threshold gray scale, the first threshold gray scale and gray scale information of the input image. The electronic device 100 may obtain the output image based on the correction coefficient that is adjusted according to the aforementioned method.

Figure 7:
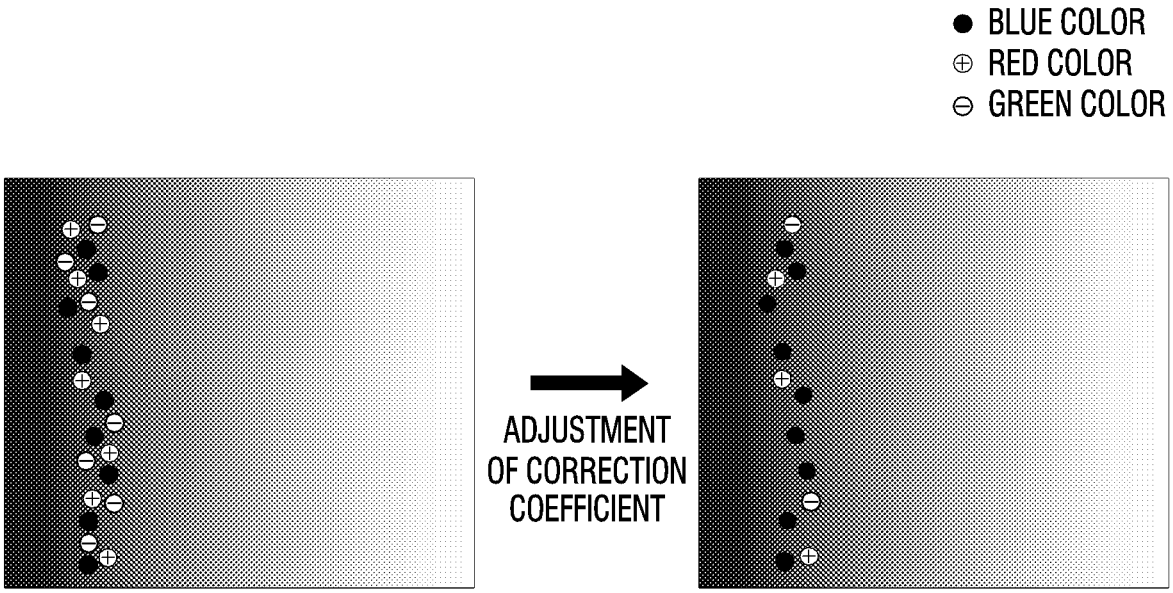
FIG. 7 is a view to describe an embodiment in which a red color and a green color included in a blue color is reduced in a low gray scale region according to an embodiment.

FIG. 7 is a view to describe an embodiment in which a red color and a green color included in a blue color is reduced in a low gray scale region according to an embodiment.

For example, a night sea image may be output. Here, each drawing shows the gray scale increasing from left to right.

Referring to the left drawing before the adjustment of correction coefficient, comparatively more red color and green color may be displayed in the output blue color region.

Referring to the right drawing after the adjustment of correction coefficient according to various embodiments, comparatively reduced number of red color and green color may be displayed in the output blue color region.

Accordingly, a user may view the night sea image in which uniformity is improved.

Figure 8:
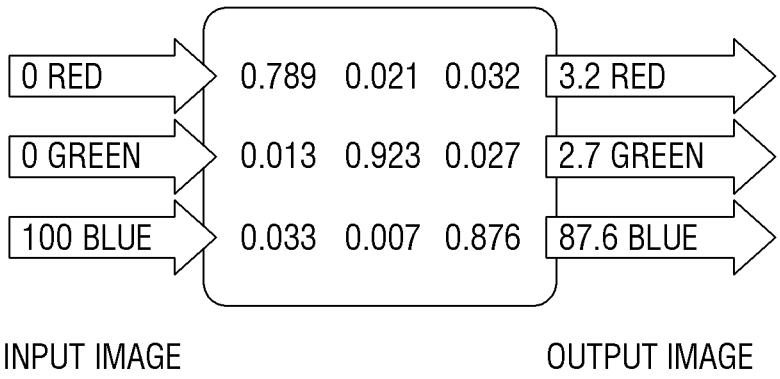
FIG. 8 is a view to describe a correction coefficient according to an embodiment.

FIG. 8 is a view to describe a correction coefficient according to an embodiment.

As illustrated in FIG. 8, when the output image is obtained from the input image, for R/G/B sub-pixels constituting the LED pixels, the R/G/B substances may be respectively adjusted and the output image may be obtained.

For example, when each of the plurality of display modules 110 includes an LED pixel, color information of the output image may be calibrated through calibration using the correction coefficient in order to calibrate color information for a uniform characteristic between the plurality of LED pixels. For example, when the input image is the pure blue color where the R/G/B pixel values are 0, 0, and 100, the R/G/B pixel values of the output image may be 3.2, 2.7, and 87.6 after being adjusted by the correction coefficients. That is, even if only the blue color is included in the input image, the red and green colors may be included in the output image.

Therefore, in order to overcome the above problem, the electronic device 100 may adjust the color information of an input image by using the correction coefficients.

According to an embodiment, when the parameter values 0.032 and 0.027 corresponding to $CC_{02}$ and $CC_{12}$ are adjusted to lower values, the light intensity of red color and green color included in the output image may be reduced.

The correction coefficient values of FIG. 8 are merely an example, and the values may be adjusted according to an input image and the user's preference.

Figure 9:
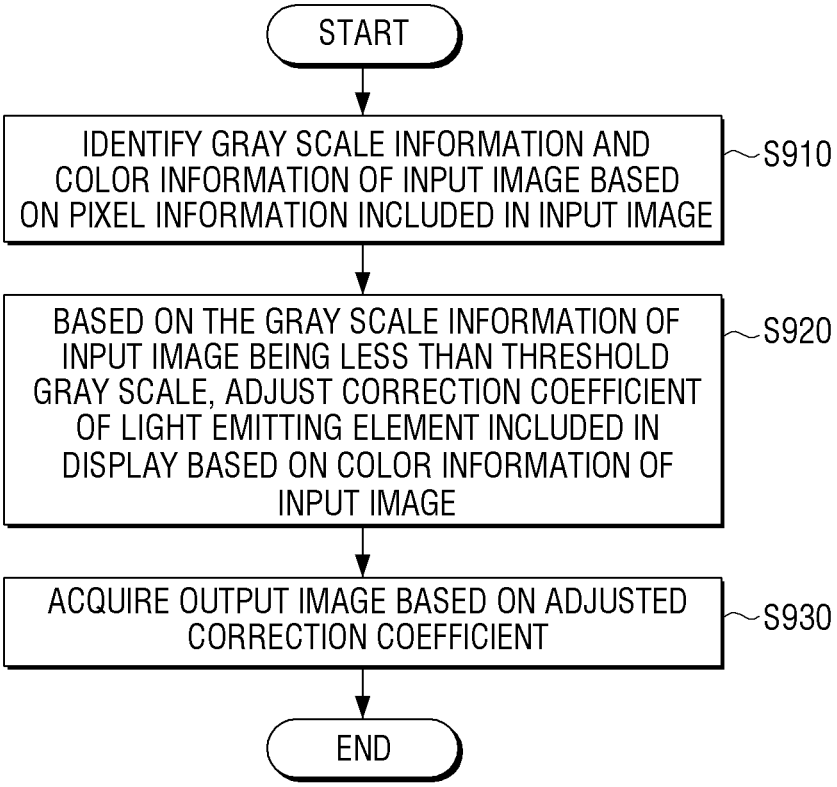
FIG. 9 is a flowchart to describe a control method of an electronic device in which correction coefficients by light emitting elements included in each of a plurality of display modules are stored according to an embodiment.

FIG. 9 is a flowchart to describe a control method of an electronic device in which correction coefficients by light emitting elements included in each of the plurality of display modules are stored according to an embodiment.

The electronic device 100 may identify gray scale information and color information of the input image based on pixel information included in the input image in operation S910.

When the gray scale information of the input image is less than the threshold gray scale, the electronic device 100 may adjust the correction coefficient of the light emitting element included in at least one of the plurality of display modules based on the color information of the input image in operation S920.

Here, the correction coefficient may include a plurality of parameters used for calculation of each of the R, G, and B sub-pixels included in the output image.

When it is identified that the gray scale information of the input image is less than the threshold gray scale (e.g., second threshold gray scale), and the color information of the input image is identified as blue color, the correction coefficient of the light emitting device corresponding to the blue color may be adjusted.

For example, if the gray scale information of the input image is less than the first threshold gray scale, the electronic device 100 may set a parameter used to calculate at least one of R and G sub-pixel values included in the output image among the plurality of parameters to zero.

Alternatively, when the gray scale information is not less than the first threshold gray scale and less than the second threshold gray scale, the electronic device 100 may adjust the parameter values used to calculate at least one of the R and G sub-pixels includes in the output image among the plurality of parameters to a specific value.

Here, the specific value may be determined based on the first threshold gray scale, the second threshold gray scale, and gray scale information of the input image based on Equation 2 provided above. Specifically, the first threshold gray scale may be determined in a pixel value section in which the B sub-pixel value included in the input image exceeds 0 and is less than the first value.

The second threshold gray scale may be determined in the pixel value section in which the B sub-pixel value included in the input image is greater than or equal to each of the R and G sub-pixels by a threshold range.

When the output image is a still image or the distance between the electronic device 100 and the user is within a threshold distance, the electronic device 100 may adjust the correction coefficient of the light emitting element included in at least one of the plurality of display modules. Here, the still image may not only include one scene that does not move, but may also include a change in pixel value between scenes that is equal to or less than a threshold value. The pixel value may be calculated as an average value of pixels of a scene or an average pixel value of a predetermined region.

When a region having a blue color in the input image is greater than or equal to a threshold size, and the gray scale information of the region is less than a threshold gray scale, the electronic device 100 may adjust a correction coefficient of a light emitting element corresponding to a pixel included in the region.

The electronic device 100 may obtain an output image based on the adjusted correction coefficient in operation S930.

In this case, output of red color and green color may be reduced in the output image of the blue color. Therefore, the user may watch an output image with enhanced uniformity.

Each of the plurality of display modules may be implemented as an LED cabinet including a plurality of LED elements.

The methods according to the various embodiments as described above may be implemented as an application format installable in an existing electronic device.

The methods according to the various embodiments as described above may be implemented as software upgrade or hardware upgrade for an existing electronic device.

The various embodiments described above may be performed through an embedded server provided in an electronic device, or an external server of at least one electronic device and a display device.

Furthermore, various embodiments of the disclosure may be implemented in software, including instructions stored on machine-readable storage media readable by a machine (e.g., a computer). An apparatus may call instructions from the storage medium, and execute the called instruction, including an electronic apparatus (for example, electronic apparatus A) according to the embodiments herein. When the instructions are executed by a processor, the processor may perform a function corresponding to the instructions directly or by using other components under the control of the processor. The instructions may include code generated by a compiler or code executable by an interpreter. A machine-readable storage medium may be provided in the form of a non-transitory storage medium. Herein, the term "non-transitory" denotes that a storage medium does not include a signal, but is tangible and does not distinguish the case in which data is semi-permanently stored in a storage medium from the case in which data is temporarily stored in a storage medium.

According to an embodiment, the method according to various embodiments herein may be provided in a computer program product. A computer program product may be exchanged between a seller and a purchaser as a commodity. A computer program product may be distributed in the form of a machine-readable storage medium (e.g., compact disc read only memory (CD-ROM)) or distributed online through an application store (e.g. PlayStore™) directly between two user devices (e.g., smartphones). In the case of on-line distribution, at least a portion of the computer program product may be stored temporarily or at least temporarily in a storage medium such as a manufacturer's server, a server of an application store, or a memory of a relay server.

In addition, one or more embodiments described above may be implemented in a computer readable medium, such as a computer or similar device, using software, hardware, or combination thereof. In some cases, the one or more embodiments described herein may be implemented by the processor itself. According to a software implementation, embodiments such as the procedures and functions described herein may be implemented with separate software modules. Each of the software modules may perform one or more of the functions and operations described herein.

According to the embodiments, computer instructions for performing the processing operations of the apparatus may be stored in a non-transitory computer-readable medium. The computer instructions stored in the non-transitory computer-readable medium may cause a particular apparatus to perform the processing operations on the apparatus according to the one or more embodiments described above when executed by the processor of the particular apparatus.

Non-transitory computer readable medium is a medium that semi-permanently stores data and is readable by the apparatus. Examples of non-transitory computer-readable media may include CD, DVD, hard disk, Blu-ray disk, USB, memory card, ROM, or the like.

Each of the elements (for example, a module or a program) according to various embodiments may be composed of a single entity or a plurality of entities, and some sub-elements of the above mentioned sub-elements may be omitted. The elements may be further included in various embodiments. Alternatively or additionally, some elements may be integrated into one entity to perform the same or similar functions performed by each respective element prior to integration. One or more operations performed by a module, program, or other element, in accordance with various embodiments, may be performed sequentially, in a parallel, repetitive, or heuristically manner, or at least some operations may be performed in a different order.

While the disclosure has been shown and described with reference to various embodiments, it will be understood by those skilled in the art that various changes in form and details may be made therein without departing from the spirit and scope of the disclosure as defined by the appended claims and their equivalents.

What is claimed is:

1. An electronic device comprising:

a display comprising light emitting elements;

a memory storing correction coefficients of the light emitting elements of the display; and a processor configured to:

identify gray scale information and color information of an input image based on pixel information of the input image, based on the gray scale information of the input image being less than a threshold gray scale, adjust a correction coefficient, among the correction coefficients, of a light emitting element among the light emitting elements of the display based on the color information of the input image, and obtain an output image based on the adjusted correction coefficient, wherein the correction coefficient comprises a plurality of parameters for calculating each of red (R), green (G) and blue (B) sub-pixel values in the output image, and wherein the processor is further configured to, based on the gray scale information of the input image being less than a first threshold gray scale, adjust a parameter, among the plurality of parameters, for calculating at least one of the R and G sub-pixels included in the output image, to zero; and based on the gray scale information of the input image being greater than or equal to the first threshold gray scale and less than a second threshold gray scale, adjust the parameter, among the plurality of parameters, for calculating the at least one of the R and G sub-pixels included in the output image, to a specific value.

2. The electronic device of claim 1, wherein the processor is further configured to, based on the gray scale information of the input image being less than the threshold gray scale and the color information of the input image being a blue color, adjust a correction coefficient, among the correction coefficients, of a light emitting element corresponding to the blue color among the light emitting elements of the display.

3. The electronic device of claim 1, wherein the specific value is determined based on the first threshold gray scale, the second threshold gray scale, and the information on gray scale of the input image.

4. The electronic device of claim 1, wherein the first threshold gray scale is determined in a pixel value section in which a B sub-pixel value included in the input image is greater than zero and is less than a first value, and the second threshold gray scale is determined in the pixel value section in which the B sub-pixel value included in the input image is greater than each of the R and G sub-pixels by at least a threshold range.

5. The electronic device of claim 1, further comprising:

a sensor, wherein the processor is further configured to, based on the output image being a still image or a distance between the electronic device and a user sensed by the sensor being within a threshold distance, adjust the correction coefficient of the light emitting element.

6. The electronic device of claim 1, wherein the processor is further configured to, based on a region having a blue color in the input image being greater than or equal to a threshold size, and gray scale information of the region being less than the threshold gray scale, adjust a correction coefficient, among the correction coefficients, of a light emitting element corresponding to a pixel included in the region among the light emitting elements of the display.

7. The electronic device of claim 1, wherein the light emitting elements comprise light emitting diodes (LED) elements, the display comprises a plurality of display modules, and each display module of the plurality of display modules is implemented as an LED cabinet comprising the LED elements.

8. A method of controlling an electronic device storing correction coefficients of light emitting elements included in a display, the method comprising:

identifying gray scale information and color information of an input image based on pixel information of the input image;

based on the gray scale information of the input image being less than a threshold gray scale, adjusting a correction coefficient, among the correction coefficients, of a light emitting element among the light emitting elements of the display based on the color information of the input image; and obtaining an output image based on the adjusted correction coefficient, wherein the correction coefficient comprises a plurality of parameters for calculating each of red (R), green (G), and blue (B) sub-pixel values in the output image, wherein the adjusting the correction coefficient further comprises:

based on the gray scale information of the input image being less than a first threshold gray scale, adjust a parameter, among the plurality of parameters, for calculating at least one of the R and G sub-pixels included in the output image, to zero, and based on the gray scale information of the input image being greater than or equal to the first threshold gray scale and less than a second threshold gray scale, adjust the parameter, among the plurality of parameters, for calculating the at least one of the R and G sub-pixels included in the output image, to a specific value.

9. The method of claim 8, wherein the adjusting the correction coefficient comprises, based on the gray scale information of the input image being less than the threshold gray scale and the color information of the input image being a blue color, adjusting a correction coefficient, among the correction coefficients, of a light emitting element corresponding to the blue color among the light emitting elements of the display.

10. The method of claim 8, wherein the specific value is determined based on the first threshold gray scale, the second threshold gray scale, and the information on gray scale of the input image.

11. The method of claim 8, wherein the first threshold gray scale is determined in a pixel value section in which a B sub-pixel value included in the input image is greater than zero and is less than a first value, and the second threshold gray scale is determined in the pixel value section in which the B sub-pixel value included in the input image is greater than each of the R and G sub-pixels by at least a threshold range.

12. The method of claim 8, wherein the adjusting the correction coefficient comprises, based on the output image being a still image or a distance between the electronic device and a user being within a threshold distance, adjusting the correction coefficient of the light emitting element.

13. The method of claim 8, wherein the adjusting the correction coefficient comprises, based on a region having a blue color in the input image being greater than or equal to a threshold size, and gray scale information of the region being less than the threshold gray scale, adjusting a correction coefficient, among the correction coefficients, of a light emitting element corresponding to a pixel included in the region among the light emitting elements of the display.

14. The method of claim 8, wherein the light emitting elements comprise light emitting diodes (LED) elements, the display comprises a plurality of display modules, and each display of the plurality of display modules is implemented as an LED cabinet comprising the LED elements.

* * * * *